US009121371B2

(12) United States Patent
Jiles et al.

(10) Patent No.: US 9,121,371 B2
(45) Date of Patent: Sep. 1, 2015

(54) APPARATUS AND METHOD FOR ALTERING THE PROPERTIES OF FUEL BY PROCESSING THROUGH THE APPLICATION OF A MAGNETIC FIELD

(71) Applicant: DynaPulse, L.L.C., Minnetonka, MN (US)

(72) Inventors: David C. Jiles, Ames, IA (US); Steffen Magnell, Plymouth, MN (US); Mani Mina, Ames, IA (US)

(73) Assignee: DynaPulse, L.L.C., Minnetonka, MN (US)

( * ) Notice: Subject to any disclaimer, the term of this patent is extended or adjusted under 35 U.S.C. 154(b) by 230 days.

(21) Appl. No.: 13/834,855

(22) Filed: Mar. 15, 2013

(65) Prior Publication Data

US 2014/0262939 A1 Sep. 18, 2014

(51) Int. Cl.
*F02M 27/04* (2006.01)
*F02M 27/00* (2006.01)

(52) U.S. Cl.
CPC ..... *F02M 27/04* (2013.01); *F02M 2027/047* (2013.01)

(58) Field of Classification Search
CPC ..... F02M 27/00; F02M 27/04; F02M 27/045; F02M 2027/047
USPC ..... 204/155–156, 554, 557, 660
See application file for complete search history.

(56) References Cited

U.S. PATENT DOCUMENTS

| | | | | |
|---|---|---|---|---|
| 5,829,420 | A * | 11/1998 | Kita et al. | 123/538 |
| 6,706,196 | B2 * | 3/2004 | Holland | 210/695 |
| 2014/0202864 | A1 * | 7/2014 | Hasegawa et al. | 204/557 |

OTHER PUBLICATIONS

Tao, R. et al. (2006). Energy & Fuels, 20, 2046-2051.*

* cited by examiner

*Primary Examiner* — Brian McCaig
(74) *Attorney, Agent, or Firm* — Pauly, Devries Smith & Deffner, LLC

(57) ABSTRACT

A system and method for altering the properties of a fuel by exposure of the fuel to a magnetic field is described herein. The method comprises generating a magnetic field; exposing a material to the magnetic field, and determining the optimum settings of the magnetic field parameters for the particular material. The magnetic field may be time varying or time invariant. Various properties of the magnetic field can be altered to determine the optimum settings for altering the fuel properties, including the amplitude, frequency, and waveform. In one embodiment, a method for improving the performance of a fuel is provided, comprising: providing a fuel line comprising fuel; installing a magnetic field generator along at least a portion of the fuel line; and generating a pulsed magnetic field around at least a portion of the fuel line using the magnetic field generator.

7 Claims, 1 Drawing Sheet

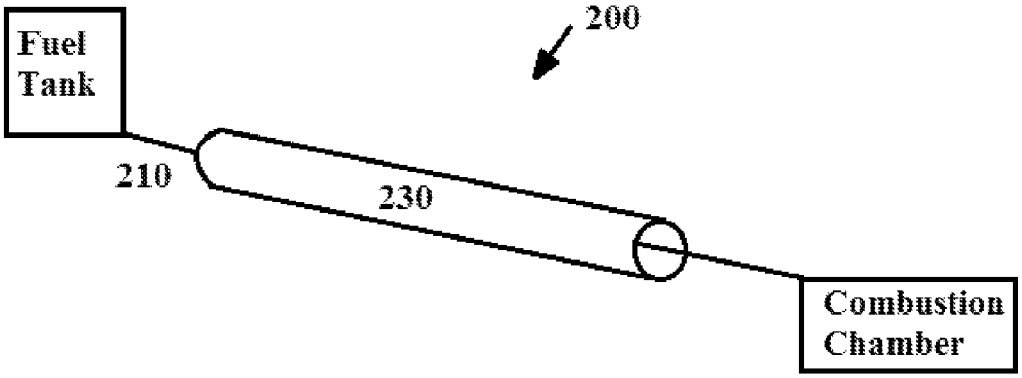
200
Fuel Tank
210
230
Combustion Chamber

APPARATUS AND METHOD FOR ALTERING THE PROPERTIES OF FUEL BY PROCESSING THROUGH THE APPLICATION OF A MAGNETIC FIELD

FIELD OF THE INVENTION

This disclosure relates generally to fuels and, more particularly, to the exposure of fuels to magnetic fields and related methods to alter their properties.

BACKGROUND

In recent years, the United States Energy Information Administration estimated that the United States consumed about 6.87 billion gallons of petroleum in a year. Approximately 72% of the 6.87 billion gallons were used for gasoline (46%), diesel fuel (18%), and jet fuel (8%). Increasing the efficiency of products that use gasoline, diesel fuel, or jet fuel to operate, will decrease the expense to operate those products by using less fuel, as well as decrease the overall demand for fuels, thereby decreasing the cost for those fuels.

Fuel injection technology is employed in most combustion systems including internal combustion engines. Atomization plays an important role in combustion efficiency and pollutant emissions. Specifically, a finer lighter fuel burns more efficiently.

SUMMARY OF THE INVENTION

The present invention is directed in part to a method for altering the properties of a fuel by exposure of the material to a magnetic field, the method comprising: generating a magnetic field; exposing a fuel to the magnetic field, and determining the optimum settings of the magnetic field for altering the properties of the fuel in a controlled way. In one embodiment of the invention, a coil is used to generate a magnetic field, and a pulse generator is used to generate a waveform.

While the use of mechanical changes to an engine itself and chemical additives to the fuel are quite widespread, the use of other methods based on classical physical phenomena such as optical, acoustic, electric, magnetic and radiative treatments are less widely used.

In the present invention, a fuel is exposed to a magnetic field in order to alter the properties of the fuel, and more specifically, to alter the viscosity properties of the fuel. In one embodiment, the magnetic field may be time-varying. In another embodiment, the magnetic field may be time invariant. The magnetic field may be generated in any number of ways, including through the use of coils or other devices carrying an electric current or through the use of one or more permanent magnets. By exposing a fuel to a magnetic field, any number of the properties of the fuel may be altered, including, but not limited to, viscosity, density, specific gravity, and conductivity. The magnetic field is typically varied over time.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present invention is defined by the appended claims and their legal equivalents.

FIGURES

The invention may be more completely understood in connection with the following drawings, in which:

FIG. 1 is one embodiment of a system of the present invention used to fuel in a fuel line.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION

The present invention is directed to a method for altering the properties of a fuel by exposure of the material to a magnetic field, comprising: generating a magnetic field; exposing a fuel to the magnetic field; and determining the optimum values for the amplitude and frequency of the magnetic field in order to alter properties of the fuel. The fuel can comprise one or more of the following: diesel fuel, gasoline, kerosene, ethanol, liquefied petroleum gas, marine fuel, and jet fuel.

In an example implementation, the invention is directed to a method for improving the fuel efficiency of an engine by decreasing the viscosity of the fuel, comprising: providing a fuel line; installing a magnetic field generator along at least a portion of the fuel line; and generating a pulsed magnetic field around the fuel line using the magnetic field generator; wherein the viscosity of the fuel is decreased after treatment with the pulsed magnetic field.

In the present invention, a fuel is exposed to a magnetic field. In one embodiment, the magnetic field may be time-varying. In another embodiment, the magnetic field may be time invariant. The magnetic field may be generated in any number of ways, including through the use of coils or other devices carrying an electric current or through the use of one or more permanent magnets. By exposing a fuel to the magnetic field any number of the properties of the fuel may be altered, including, but not limited to, viscosity, density, specific gravity, and conductivity.

In one embodiment, the present invention is directed to a system for subjecting a fuel within a fuel line to a magnetic field for the purpose of altering the properties of the fuel, comprising: a coil configured to generate a magnetic field; a pulse generator configured to generate a waveform; and a power supply configured to generate a current in the coil.

In one embodiment of the system 200, the fuel is in a fuel line 210, as shown in FIG. 2. In an embodiment, a magnetic field generator 230 is used to generate a magnetic field around the fuel line 210. In a preferred embodiment, the magnetic field generator 230 produces a pulsed magnetic field.

In one embodiment, the magnetic field generator 230 may be an external wand for generating a magnetic field around the material to be treated. The external wand can be mounted in close proximity to the fuel line, such that the fuel line is within the magnetic field. In another embodiment, the magnetic field generator 230 may be a cylindrical chamber that is open-ended on both sides, as in the example in FIG. 2, or be a chamber with a clam shell design. In yet another embodiment, the magnetic field generator 230 may be a coil wrapped around the fuel line comprising the fuel to be treated. The magnetic field generator 230 may comprise a power supply and a pulse generator to provide a pulsed magnetic field.

In one embodiment, the average strength of the magnetic field varies from 6 to 20 G. Where a magnetic field generator 230 is a coil, the average field strength may be approximately 6 G at the center of the coil and around 20 G around the edges of the coil. In another embodiments, the average magnetic field strength ranges from 6 to 40 G with a field strength of 6 G at the center of the coil and around 40 G around the edges of the coil. These ranges are also applicable where the magnetic field generator 230 is not coil. Also, fields outside of these ranges can be used in some implementations.

Magnetic fields can have different effects on fuels depending on the type of field exposure and on the type of material. Magnetic fields to which fuels may be exposed may either be constant or pulsed. The field exposure may be from a direct current (DC) or alternating current (AC) source and may vary by amplitude, frequency, or waveform.

Optimum settings of a magnetic field must be determined for a given fuel. Significantly, the optimum settings of a magnetic field for one fuel may not be the same for a different fuel. Thus, various settings must be tested for particular fuels. The settings include such values as amplitude, frequency, and waveform.

The field may oscillate with various waveforms, including sinusoidal wave, square wave, or triangle wave.

These effects are classified herein as irreversible and reversible. Irreversible effects cause changes in measurable properties of a fuel, such as viscosity, specific gravity, density, and conductivity. Reversible effects cause a change in a measurable property but then revert to their original values when the field is removed.

In an embodiment, the magnetic field generator can be located near a fuel tank, such as a holding tank for fuel prior to the fuel entering a fuel line to a combustion engine. In an embodiment, as the fuel passes through the fuel line, the fuel also passes through a magnetic field. Fuel passing through a magnetic field can result in the fuel having a decreased viscosity. Fuel having a decreased viscosity can have a smaller droplet size when it pass through a fuel injector into a combustion chamber and thereby can result in a more efficient combustion of the fuel.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention has been described with reference to various specific and preferred embodiments and techniques. However, it should be understood that many variations and modifications may be made while remaining within the spirit and scope of the invention.

The invention claimed is:

1. A method for altering the properties of a fuel, comprising:

providing fuel through a fuel line;

providing a magnetic field generator; and generating a pulsed magnetic field with the magnetic field generator;

wherein the generated pulsed magnetic field has an average field strength ranging from 6 to 40 G.

2. The method of claim 1, wherein the generated magnetic field has an average field strength ranging from 6 to 20 G.

3. The method of claim 1, wherein the magnetic field generator provided comprises a coil, a pulse generator, and a power supply.

4. A method for decreasing the viscosity of a fuel, comprising:

Generating a pulsed magnetic field around a fuel line, wherein the pulsed magnetic field is generated using a coil and pulse generator, and, wherein the generated pulsed magnetic field has an average field strength ranging from 6 to 40 G within the coil.

5. A method for decreasing the viscosity of a fuel, comprising:

Generating a pulsed magnetic field around a fuel line, wherein the pulsed magnetic field is generated using a coil and pulse generator, and, wherein the generated pulsed magnetic field has an average field strange ranging from 6 to 20 G within the coil.

6. The method of claim 5, wherein the pulsed magnetic field is generated using a wand.

7. A system for improving a fuel, comprising:

a fuel;

a magnetic field generator configured to generate a magnetic field around the fuel; and at least one of a current or voltage source, wherein the fuel comprises diesel fuel, and wherein the magnetic field generator comprises an external wand.

* * * * *